US005244116A

United States Patent [19]

Leo

[11] Patent Number: 5,244,116

[45] Date of Patent: Sep. 14, 1993

[54] COSMETIC SAMPLE DISPENSER WITH REPLACEABLE MAGAZINES

[76] Inventor: Daniel W. Leo, 163 Lexington Ave., New York, N.Y. 10016

[21] Appl. No.: 864,414

[22] Filed: Apr. 6, 1992

[51] Int. Cl.[5] ..... B65H 1/08

[52] U.S. Cl. ..... 221/232; 221/274

[58] Field of Search ..... 221/69, 270, 226, 232, 221/272, 273, 274, 247, 279; 271/128

[56] References Cited

U.S. PATENT DOCUMENTS 4,471,885 9/1984 Mallialone ..... 221/232

4,789,079 12/1988 Kobayashi et al. ..... 221/232

FOREIGN PATENT DOCUMENTS 23695 10/1897 United Kingdom ..... 221/232

*Primary Examiner*—Robert P. Olszewski

*Assistant Examiner*—Kenneth Noland

*Attorney, Agent, or Firm*—Charles E. Temko

[57] ABSTRACT

A cosmetic sample dispenser having plural replaceable magazines supported on a common base. Each of the magazines is positioned within a recess in the base and maintained in operative position by a latch against an ejector spring. The individual magazines each include an elongated main housing enclosing a follower plate and follower spring for urging stacked rectangular planar samples upwardly to a point of dispensing. A tubular sleeve element surrounds the main housing for relative axial manually imparted movement to actuate an ejector means for projecting one end of an upwardmost sample in a stack outwardly through an exit opening where it may be manually grasped for removal by a user. Upon release of an end wall of the housing the ejector spring returns the main housing to its original position within its respective recess and relative to the sleeve element for reactivation. Aligned openings are provided in both the housing and the sleeve element to permit inspection and reloading of samples by depressing the follower plate below the opening.

7 Claims, 3 Drawing Sheets

COSMETIC SAMPLE DISPENSER WITH REPLACEABLE MAGAZINES

BACKGROUND OF THE INVENTION

This invention relates generally to the field of serial dispensers for relatively small objects, and more particularly to an improved dispenser particularly adapted for the dispensing of coated cosmetic samples of a product such as lipstick or nail polish in which the product is available in a relatively large variety of tints and hues of several basic colors. Devices of this general type are known in the art, and the invention lies in specific constructional details which permit improved ease of operation on the part of the user and the facilitating of replacement of an empty supply of samples of a particular tint or hue when required. In recent years, for hygienic reasons, it has become mandatory for stores to provide single use samples of products of this type for selection by a customer who may place the sample adjacent a fingernail or the lips and view the effect directly or with the aid of a mirror. Once a selection is made, the sample is discarded. Since the first sample chosen is not always ultimately selected, it is necessary for the store to provide a relatively large number of samples of each variation of the product for ready accessibility to the customer.

SUMMARY OF THE INVENTION

Briefly stated, the invention contemplates the provision of an improved sample dispensing device of the class described including a base element defining a large number of elongated recesses, each capable of engaging and supporting a replaceable magazine containing a plurality of planar rectangular sample cards displaying a particular color or variation of a single product such as lipstick or nail polish on an upper surface thereof. Each magazine is activated by a customer by pressing downwardly upon an upper wall of the magazine, an outer surface of which displays the selected color, to result in the magazine partially ejecting an end of a product sample so that it may be manually grasped for removal and use. Upon release of the upper wall, the magazine returns to its original condition with an ejecting means repositioning itself for reactivation upon a subsequent use. When the magazine is exhausted, a latch interconnecting the magazine within the recess is manually released to permit removal of the magazine for reloading and replacement. The magazine includes a main housing or shell containing a follower plate and follower spring which advances the samples upwardly to a point of transversely oriented ejection. The housing is surrounded by a rectangular shell capable of relative movement. An ejector means includes a plurality of internal links pivotally moved by such relative movement. During such movement, the sleeve element is maintained in latched relation relative to the recess against axial movement, and the housing moves downwardly against a spring means at the bottom of the recess which returns the magazine to its original condition after a dispensing action. The magazine is removed by unlatching the sleeve element, permitting the same spring means to partially extract the magazine from the recess.

BRIEF DESCRIPTION OF THE DRAWINGS

In the drawings to which reference will be made in the specification, similar reference characters have been employed to designate corresponding parts throughout the several views.

DETAILED DESCRIPTION OF THE DISCLOSED EMBODIMENT

Figure 5:
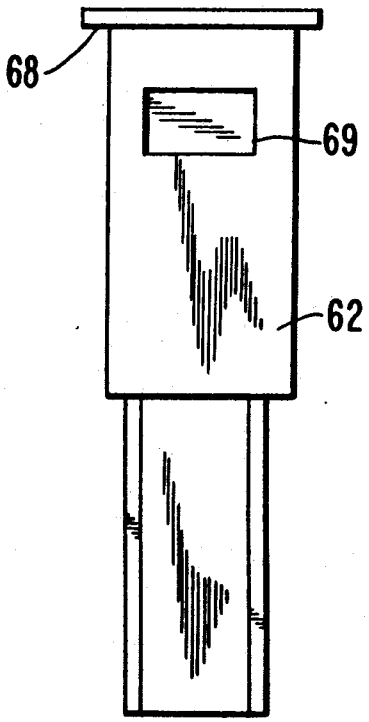
FIG. 5 is an end elevational view of the magazine element.

In accordance with the invention, the device, generally indicated by reference character 10, comprises broadly: a base element 11, a plurality of detachable magazines, one of which is indicated by reference character 12, and individual planar samples 13.

Figure 1:
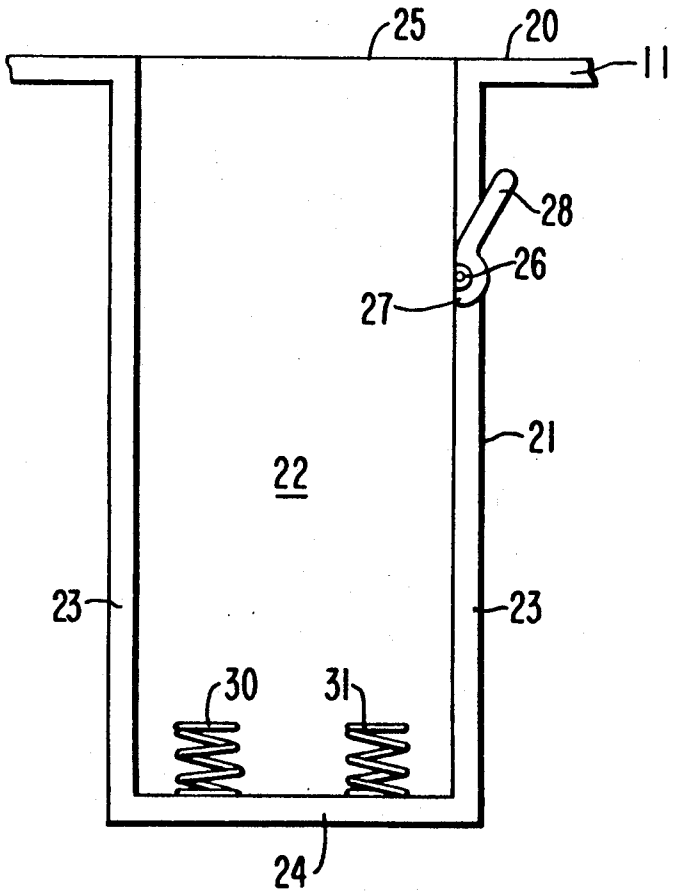
FIG. 1 is a fragmentary schematic side elevational view of a base element forming a part of the disclosed embodiment.
Figure 2:
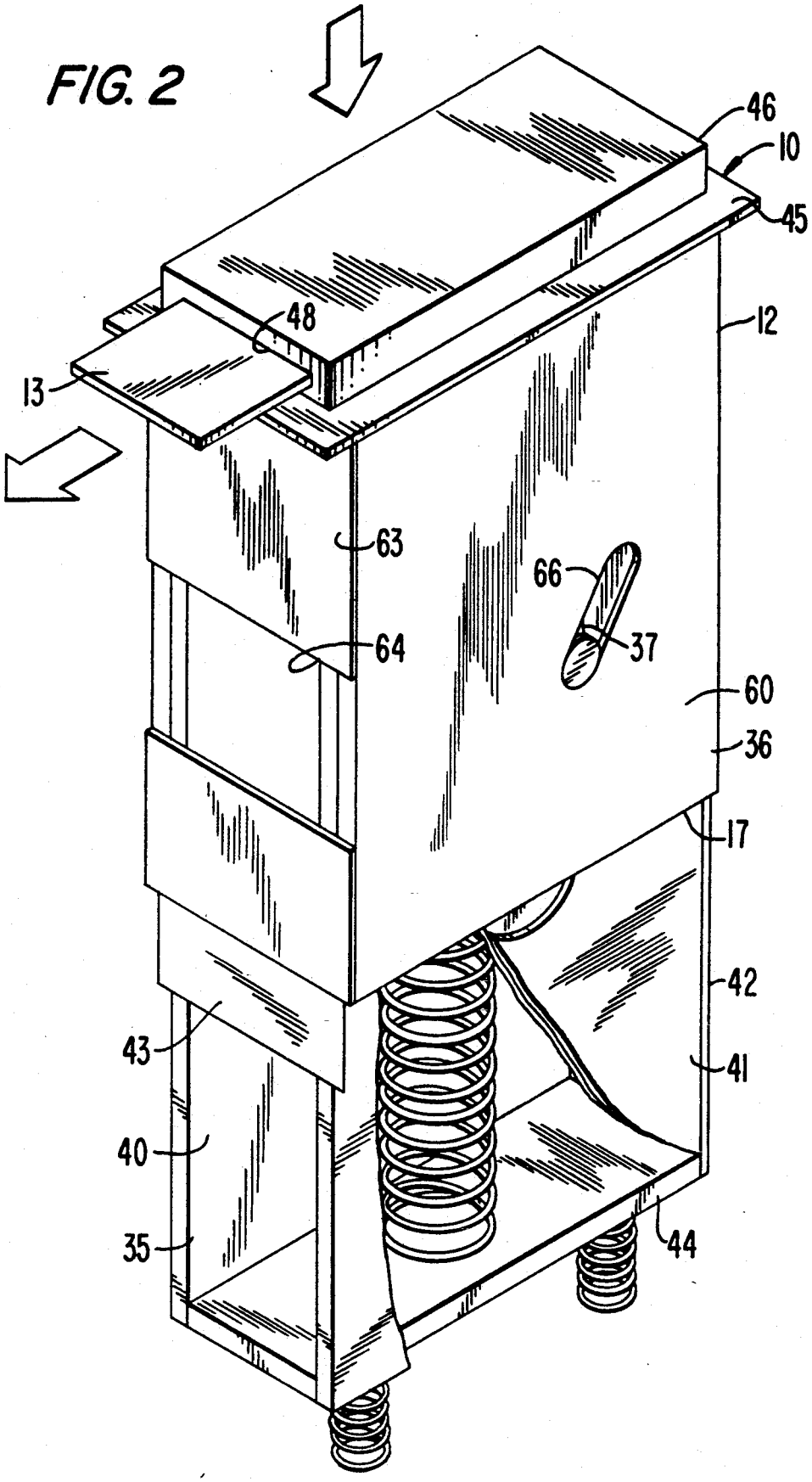
FIG. 2 is a view in perspective, partially broken away to show detail of an individual magazine element forming another part of the disclosed embodiment.

The base element 11 is preferably of molded construction, to include one or more horizontal walls, one of which is indicated by reference character 20, from which depend vertical magazine receiving recesses, one of which is indicated by reference character 21. Each recess 21 is of rectangular configuration, and bounded by a pair of side walls 22, a pair of end walls 23, and a bottom wall 24, the walls 22 and 23 defining a rectangular upper opening 25. Mounted on one of the end walls 23 is pivotally mounted latch member 26 including a latching terminal 27 and a manually engagable lever 28. Resilient means (not shown) normally urges the latch member 26 to the position shown in FIG. 1, so that engagement of the lever 28 is only necessary to withdraw the terminal 27 from engagement with a magazine 12. Mounted on an upper surface of the bottom wall 24 are plurality of compression springs 30 and 31 which, as will more fully appear, serve to provide a resilient force for operation of the magazine, and also as a means for resiliently extracting the magazine when replacement is desired.

The magazines 12 are essentially similar, and accordingly, a description of one such magazine will serve to describe all. The magazine is also preferably of molded synthetic resinous construction, and includes an inner housing element 35, an outer sleeve element 36 and a pivotally actuated ejector element 37 positioned between the elements 35 and 36.

The inner housing element 35 includes first and second side walls 40 and 41, a first end wall 42, and an orificed end wall 43, as well as a lower wall 44 and an upper wall 45. The upper wall 45 is also orificed (not shown) and mounts a hollow dispensing member 46 forming an ejection recess 47 for the uppermost sample 13 in a stack of such samples. Communicating with the recess 47 is an ejection slot 48. It will be observed that the upper wall 45 is slightly larger than the lower wall 47, and a lower surface thereof rests upon the base element 11 in flush relationship when the magazine is engaged within a respective recess.

Disposed within the housing element 35 is a rectangular follower plate 50 urged upwardly by a follower spring 51 to move a stack 52 of samples 13 serially to the recess 47 for ejection. Most conveniently, the upper surface 54 of each sample 13 is coated or otherwise treated to display a desired tint or shade.

The outer sleeve element 36 surrounds the housing element 35, and is also preferably of molded construction. It includes first and second side walls 60 and 61, a first end wall 62 and a second end wall 63 having an opening 64 therein to permit reloading of the magazine when the sleeve is aligned such that the opening 64 is congruent with a corresponding opening in the wall 43. Each of the walls 61 and 62 defines an angularly oriented slot 66 as well as a continuous lower edge 67 and continuous upper edge 68. The end wall 63 also defines a recess 69 selectively engaged by the latching terminal 27 in known manner.

Figure 4:
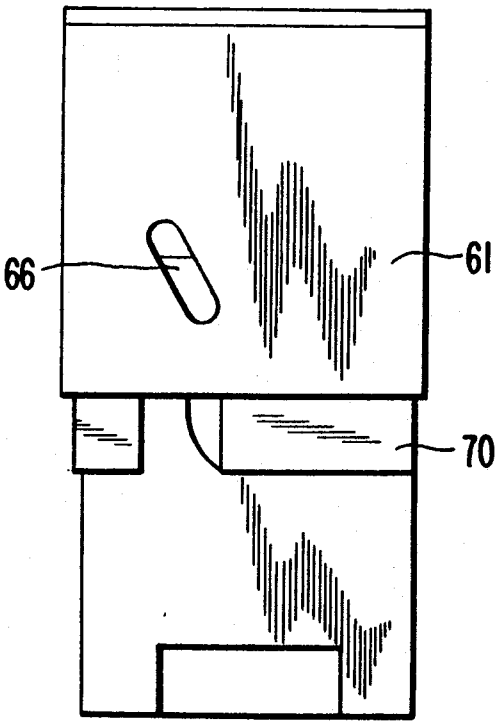
FIG. 4 is a side elevational view showing the relative position of the parts of the magazine prior to actuation.

The ejector element 37 is positioned between the elements 35 and 36 and includes an intermediate sleeve 70 (FIG. 4) having a pair of oppositely disposed elongated recesses, one of which is indicated by reference character 71 which terminates in a lower circular terminal 72 on each of two oppositely disposed walls 73. Supported within the recess 71 is a U-shaped linkage including a pair of lower circular terminals 75 at the bottom of integrally formed first and second elongated links 76 and 77. A cam follower 78 is positioned at the apex 79 of each of the legs of the linkage 74. At the upper end 80 of each of the links 76 is a pintle 81 engaging a pivotally mounted ejection member 82 including a transversely extending portion 83 and a pair of legs 84.

Figure 3:
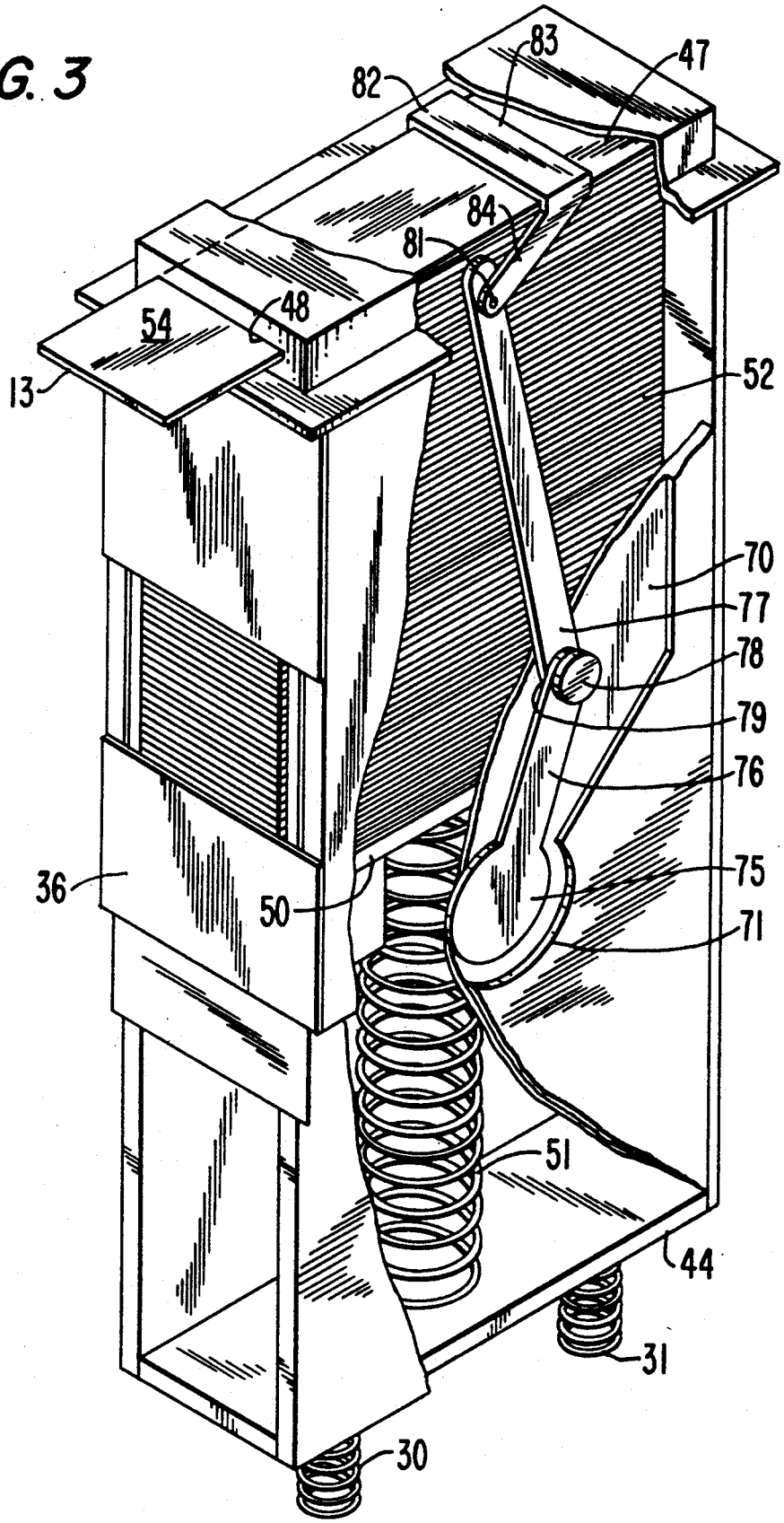
FIG. 3 is a similar fragmentary view in perspective further broken away to show detail.

Operation of the device 10 will be apparent from a consideration of FIG. 3. When the magazine 12 is positioned within the recess 21, the latch member 26 engages the recess 69 to secure the sam in position. The sleeve element 36 does not move during operation. When the upper wall 45 is depressed by a user, the housing element 35 moves downwardly within the recess 21 and relative to the sleeve element 36, this movement serving to pivotally move the links 76-77 in a clockwise direction as seen in that FIG. This results in leftward movement of the transverse member 83 which engages an end edge of a sample 13 and moves it out through the ejection slot 48 where it may be grasped by a user. Once the upper wall 45 is released by the user, the springs 30 and 31 bear against the lower wall 44 and return the device to its initial condition, during which time the ejector element 37 moves the transverse member 83 rightwardly as seen in FIG. 3 where it may engage the next sample 13 at an end edge thereof. This action may be repeated as long as there are samples 13 present in the magazine. When the magazine is exhausted, the latch member 26 is manually released, at which time the springs 30-31 either eject the magazine, or at least partially extract it so that it may be manually grasped for complete removal. The magazine is simply reloaded by depressing the follower plate 50 against the follower spring 51 and inserting a stack of samples 13 through the aligned openings in the elements 35 and 36.

It may thus be seen that I have invented novel and highly useful improvements in cosmetic sample dispensing devices in which a common base element supports a plurality of selectively replaceable magazine elements, each magazine element containing a plurality of like samples of an individual tint or hue for a convenient selection by a customer. Each of the magazines is individually replaceable when exhausted, or periodically by service personnel to prevent the magazine from becoming exhausted. By the use of synthetic resinous molding of most of the components, the cost of manufacture may be maintained at a reasonable level, and should an individual magazine become damaged, it can be replaced without the necessity of replacing the entire device.

I wish it to be understood that I do not consider the invention to be limited to the precise details of structure shown and set forth in the specification, for obvious modifications will occur to those skilled in the art to which the invention pertains.

I claim:

1. An improved cosmetic sample dispenser comprising: a base element and at least one detachable magazine element; said base element having a cavity therein including a side wall and a bottom wall for receiving said magazine element, said bottom wall having resilient means thereon, latching means projecting into said cavity for engaging said magazine element against said resilient means; said magazine element having an inner housing element and an outer sleeve element at least partially surrounding said housing element in sliding relation therewith, said housing element defining a cavity for the holding of planar samples in stacked relation, and resilient follower means for urging said stack to a point of ejection at an upper end thereof; an ejector element positioned between said housing element and said sleeve element, and actuated by manually applied force upon said housing element resulting in relative movement between said housing element and said sleeve element; said latching means engaging said sleeve element, said housing element being thereby maintained within said cavity against said resilient means during such actuation, and returned to initial relative condition upon release of said manually applied force.

2. An improved container sample dispenser in accordance with claim 1, said ejector element including an elongated linkage pivotally mounted with respect to said housing element at one end thereof, and having a camming interconnection with said sleeve element to impart a linear ejecting movement perpendicular to the axis of said magazine element at said point of ejection.

3. An improved sample dispenser in accordance with claim 2, said sleeve element having a peripheral upper edge thereon engaging a corresponding upper edge of said recess in said base element when in engaged condition relative to said latching means.

4. An improved sample dispenser in accordance with claim 3 said housing element having an upper end wall defining a transversely extending planar recess for reception of an uppermost sample in said stack of samples, said ejector element being slidably disposed within said recess, there being a slotted opening in said upper end wall through which samples are serially ejected.

5. An improved sample dispenser in accordance with claim 1, said housing element and said sleeve element having selectively alignable openings therein for the reloading of samples therethrough.

6. An improved sample dispenser in accordance with claim 1, in which said cavity in said base element and said magazine element are of rectangular configuration.

7. An improved sample dispenser in accordance with claim 1, in which said resilient means, upon release of said latch member serves to at least partially eject said magazine element from said recess in said base element.

* * * * *